US007369037B2

(12) United States Patent
Piccolo, III et al.

(10) Patent No.: US 7,369,037 B2
(45) Date of Patent: May 6, 2008

(54) PROGRAMMABLE MULTICANDELA NOTIFICATION DEVICE

(75) Inventors: Joseph Piccolo, III, Fitzwilliam, NH (US); Juan A. Martinez, Watertown, MA (US); Gary W. Vincent, Lunenburg, MA (US)

(73) Assignee: SimplexGrinnell LP, Westminster, MA (US)

( * ) Notice: Subject to any disclaimer, the term of this patent is extended or adjusted under 35 U.S.C. 154(b) by 319 days.

(21) Appl. No.: 10/872,852

(22) Filed: Jun. 21, 2004

(65) Prior Publication Data

US 2005/0128097 A1 Jun. 16, 2005

Related U.S. Application Data

(60) Provisional application No. 60/528,952, filed on Dec. 11, 2003.

(51) Int. Cl.
*G09F 25/00* (2006.01)

(52) U.S. Cl. ..... 340/286.01; 340/539.1; 340/691.4; 315/294; 315/120

(58) Field of Classification Search ..... 340/286.01, 340/331, 332, 286.05, 533, 538, 506, 539.1, 340/628, 635, 384.1, 384.6, 691.4; 315/291, 315/241 S, 294, 120
See application file for complete search history.

(56) References Cited

U.S. PATENT DOCUMENTS

| | | | | |
|---|---|---|---|---|
| 4,949,077 | A * | 8/1990 | Mbuthia | 340/628 |
| 5,659,287 | A * | 8/1997 | Donati et al. | 340/331 |
| 5,751,210 | A * | 5/1998 | Kosich | 340/293 |
| 5,777,551 | A * | 7/1998 | Hess | 340/541 |
| 5,940,175 | A * | 8/1999 | Sun | 356/237.3 |
| 6,243,001 | B1 * | 6/2001 | Kodaka | 340/326 |
| 6,281,789 | B1 * | 8/2001 | Furtado et al. | 340/506 |
| 6,311,021 | B1 * | 10/2001 | Kosich | 396/164 |
| 6,411,201 | B1 * | 6/2002 | Hur et al. | 340/332 |
| 6,426,697 | B1 * | 7/2002 | Capowski et al. | 340/506 |
| 6,459,370 | B1 * | 10/2002 | Barrieau et al. | 340/514 |
| 6,522,261 | B2 * | 2/2003 | Scheffler et al. | 340/815.73 |
| 7,006,003 | B2 * | 2/2006 | Zimmerman et al. | 340/815.4 |

* cited by examiner

*Primary Examiner*—Benjamin C. Lee
*Assistant Examiner*—Daniel Previl
(74) *Attorney, Agent, or Firm*—Brinks Hofer Gilson & Lione

(57) ABSTRACT

An alarm system notification device includes a strobe, a communication port, a manual selector that allows manual selection of strobe intensity, and a communication port through which the device transmits an indication of a selected strobe intensity. The device may also include a commandable selector that selects a strobe intensity in response to a command received from the communication port.

25 Claims, 2 Drawing Sheets

PROGRAMMABLE MULTICANDELA NOTIFICATION DEVICE

RELATED APPLICATION(S)

This application claims the benefit of U.S. Provisional Application No. 60/528,952, filed Dec. 11, 2003. The entire teachings of the above application(s) are incorporated herein by reference.

BACKGROUND

Fire alarm devices such as audible horns (audible/visible or A/V), loudspeakers (speaker/visible or S/V) and visible strobes (visible only or V/O), are referred to as "notification appliances." Typically, a fire alarm control panel (FACP) drives these devices over one or more "notification appliance circuits" (NACs). The strobes are required, for example, as an alert for the hearing-impaired, or for those in a high noise environment.

A strobe is typically made up of a high-intensity Xenon flash tube, a reflector assembly, a transparent protective dome, an electronic control circuit, a terminal block to connect the device to the NAC and a housing to install the device to a wall or ceiling.

The strobe is a notification device designed to disperse its light output in a hemispherical pattern. The light distribution must meet stringent specification for UL approval, and it typically must accurately flash at a specified rate, for example, once per second or at some multiple. Strobes in the same viewing area typically must be synchronized, as a fast flash rate or several unsynchronized strobes at the normal rate could cause susceptible people to have epileptic seizures. See for example, U.S. Pat. No. 5,886,620, incorporated by reference herein in its entirety.

A manual selector, such as a moveable jumper, typically allows manual selection of strobe intensity, as well as a visual indication of the selection to a person who can clearly see the selector.

SUMMARY OF THE INVENTION

It is desirable for fire alarm notification strobes to be able to output different intensities of light in different applications. For example a sleeping area requires a light intensity of at least 110 candela, while a small office may only require 15 candela. The different requirements for light output have traditionally been met by using different strobes in different areas or by using a strobe with a selectable output. Typically, on existing strobes with selectable intensity, a switch or jumper is used to manually select the appropriate candela setting. This leaves open the possibility of errors that may be difficult to detect during test and commissioning.

In accordance with an embodiment of the present invention, an alarm system notification device includes a strobe; a selector that allows manual selection of strobe intensity; and a communication port through which the device transmits an indication of a selected strobe intensity.

The communication port may be, but is not limited to, a wired, wireless, or optical connection. In an embodiment using a wired connection, the device transmits the selected or current strobe intensity information (indication) by superimposing the information over power lines.

In another embodiment, an alarm system notification device includes a strobe; and a communication port through which the device receives a command to select a strobe intensity. The device, in response to said command, configures itself to strobe at the selected intensity. A non-volatile memory can be used to store an indicator (such as the value itself, or some indication of the value) of the selected strobe intensity. Alternatively, a volatile memory could also be used.

In a further embodiment, the alarm system notification device includes an indicator that indicates to a person near the device the selected intensity. This can be a visual indicator, such as, for example, a LED that flashes according to the selected intensity, or a numeric display that indicates the selected intensity. Alternatively, the indicator can be an audible indicator.

In yet a further embodiment, the strobe device both receives intensity selection commands and reports current setting via a communication or network port.

An alarm system according to an embodiment of the present invention includes plural addressable alarm system notification devices, at least one notification device having a strobe and a selector which allows manual selection of strobe intensity; a control panel; and a communications channel through which the device transmits an indication of its respective selected strobe intensity to the control panel.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

A description of preferred embodiments of the invention follows.

Figure 1:
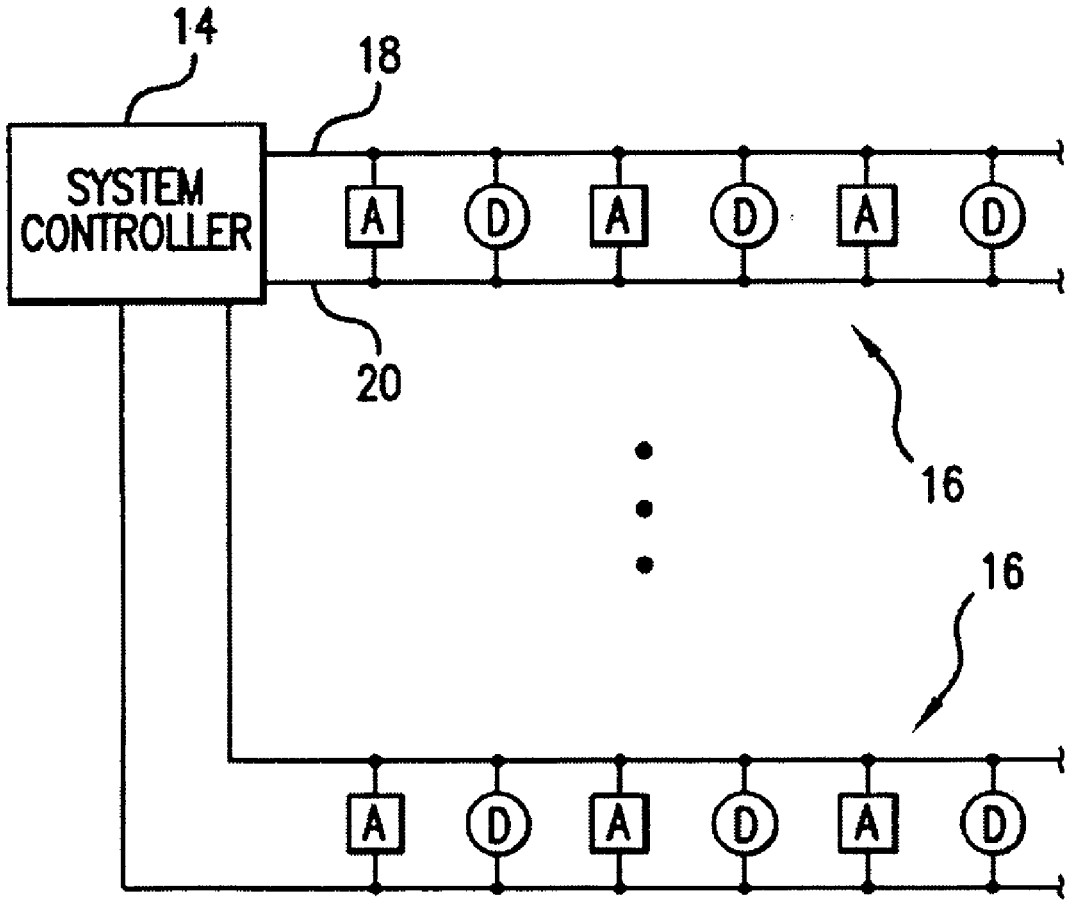
FIG. 1 is a schematic diagram illustrating a system embodying the present invention.

A system embodying the present invention is illustrated in FIG. 1. The system includes one or more notification appliance circuits (NACs), i.e., networks 16, having alarm condition detectors D and alarm notification appliances A. Alternatively, the detectors and notification appliances may be on separate networks. A system controller/FACP 14 monitors the detectors D. When an alarm condition is sensed, the system controller 14 signals the alarm to the appropriate notification appliances through one or more networks 16. Notification appliances may include, for example, a visual alarm (strobe), an audible alarm (horn), a speaker, or a combination thereof.

Although not necessary for carrying out the invention, as shown, all of the notification appliances in a network are coupled across a pair of power lines 18 and 20 that advantageously also carry communications between the system controller 14 and the detectors D and notification appliances A.

There are two main aspects to the present invention. The first is the ability to read a candela setting and report it to the fire alarm panel, confirming that each strobe is in fact programmed correctly. This may be used with strobes that have jumpers or switches to set their output. The second aspect is the ability to program the strobe via a command from the fire panel.

To program the strobes, the candela setting may be made via any means that changes the configuration setting for the device in the fire alarm panel, including, but not limited to: Software configuration tools; Fire alarm panel displays and keypads or similar user interfaces; Service port command; External computer interfaces; Internet interfaces; and Modem or other remote connection interfaces.

Once the candela setting for a device is configured in the fire alarm panel, the fire alarm panel communicates the selection to the device automatically and the device selects the configured setting for output.

This method eliminates the need to manually configure each device as it is installed. This has several advantages. For example, it allows changing or correcting candela setting without needing to access the device or replacing the device. Furthermore, labor may be reduced since need for jumper/switch setting may be eliminated. In addition, an embodiment of the invention may eliminate errors due to faulty manual configuration of a device since the intended candela setting may be set directly from a configuration established at the fire alarm panel.

In some embodiments, the device may be programmed with the candela setting via a command received from a control panel over a communications channel (digital or analog). The communication signal can, for example, be multiplexed onto the device's power line—this provides the added benefit that it saves the cost of additional wiring to devices. See for example, U.S. Pat. No. 6,426,697, incorporated by reference herein in its entirety. Alternatively, the communication line to the device may be separate from the power line. The communications channel may comprise, for example, a wireless link, a wired link or a fiber optic link.

Alternatively, or in addition, the device may be programmed manually (without its removal) via any of a variety of means, including but not limited to: optical signaling (e.g. TV remote control, blinking flashlight, light bulb or other light source, laser pointers, breaking optical beam), a magnet tapped against the device, radio frequency (RF) tags, sound signaling (e.g. ultrasonic tones, touchtones, clapping) etc.

The strobe selection data can be stored and/or updated in the device in a variety of ways. For example, in one embodiment, the intensity selection is stored in volatile memory. The device is updated from a fire alarm panel (control panel) each time the device is powered on. This saves the cost of using nonvolatile memory.

Alternatively, the intensity selection can be store in nonvolatile memory (retained when power lost). Nonvolatile memory includes, but is not limited to, FLASH memory, battery-backed RAM, battery backed electronic switches such as flip-flops or other switches, magnetic core memory, magnetic hard drives, optical media storage including but not limited to CD-ROM and DVD, and RF tags.

In other embodiments, the strobe intensity is updated continuously from the fire alarm panel whenever the device needs to strobe. In this embodiment, no memory may be required.

In some embodiments, the device reports the candela (intensity) setting to the fire alarm panel using a communication signal (digital or analog). This communication signal may be multiplexed onto the device's power line, or may be on a communication line that is separate from the power line. Alternatively, a fiber optic cable link or a wireless connection can be utilized.

Alternatively, or in addition, the device may directly report the candela setting, using for example, optical signaling (for example, an LED, an infrared emitter, a flashlight bulb or a mechanical shutter. The device may also report the setting using other means, such as RF tag reading or audio (e.g., ultrasonic, chirps, beeps, prerecorded or synthesized voice, etc.)

At least one embodiment combines, within a single device, communication to the fire alarm control panel 14 via a communication signal multiplexed onto device's power line, and an indicator at the device itself.

Figure 2:
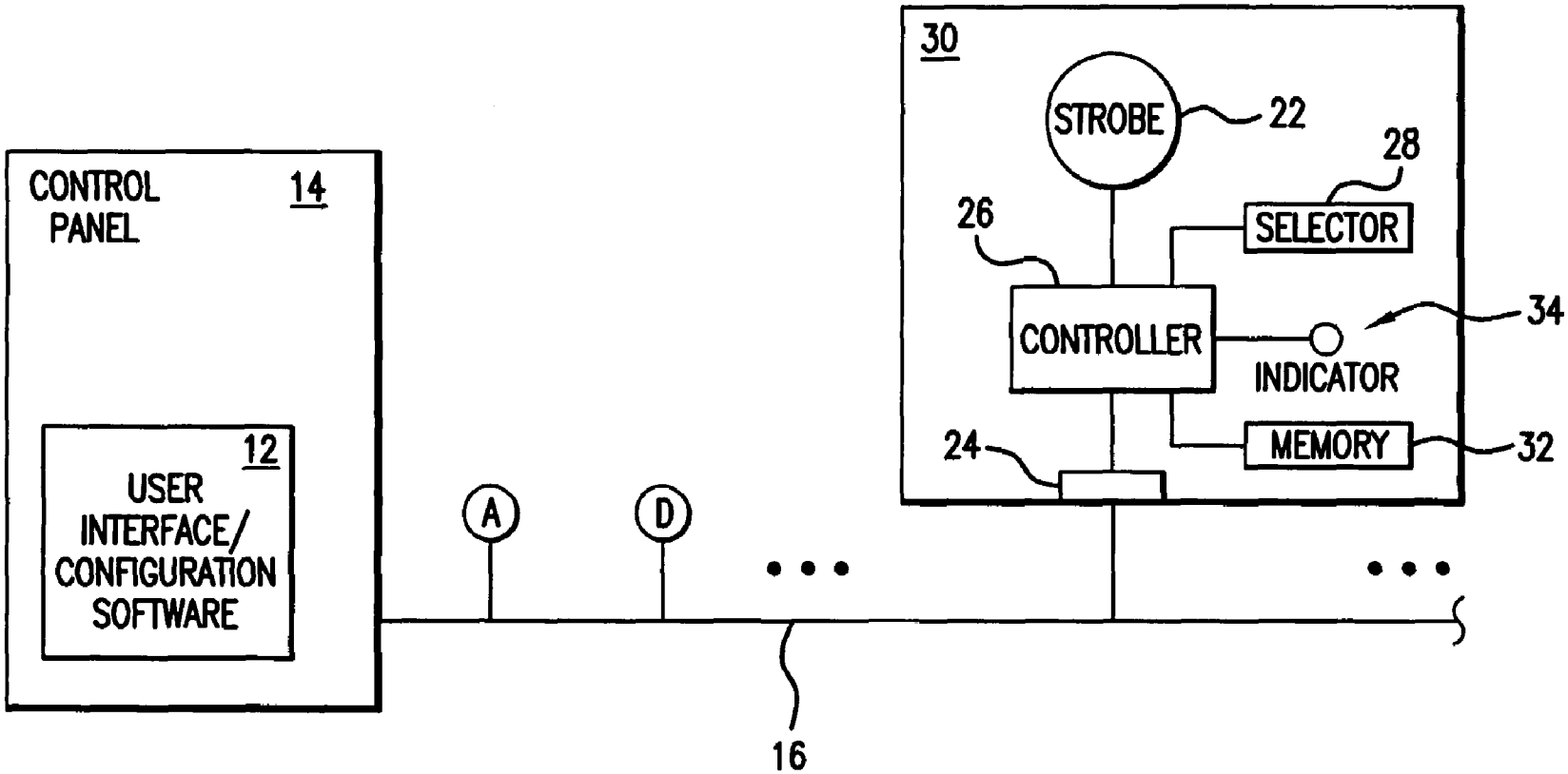
FIG. 2 is a schematic diagram of the system of FIG. 1, further illustrating details of an embodiment of the present invention.

FIG. 2 is a schematic diagram of the system of FIG. 1, further illustrating details of an embodiment of the present invention. For simplicity, the two-line network of FIG. 1 is shown with a single line 16. The control panel 14 includes a user interface and configuration software 12 which allow a user to program candela settings for individual strobe devices 30 on the network or communications channel 16. The network 16 may include addressable detection devices D, as well as other notification devices or appliances A that may or may not include strobes. The control panel 14 may further be programmed to change the candela settings for one or more strobe devices 30 upon specific events or at certain times.

Strobe device 30 connects to the network 16 via a network interface (communication connection) 24. A controller 26, such as a microcontroller or hardwired logic, receives from and sends to the control panel 14 candela configuration data. When commanded, the strobe 22 flashes at the currently configured candela setting, which may be stored in a memory (volatile or non-volatile) 32. Although shown separately, the memory 32 may be integrated with the controller 26.

In some embodiments, a selector 28, such as a set of jumpers or a DIP switch, allows manual setting of the strobe intensity (candela setting). In at least one embodiment, this manual setting can be overwritten upon command from the control panel 14.

In some embodiments, an indicator 34, such as a flashing LED, indicates the currently configured candela setting, for example, upon command from the control panel 14, upon a local manual command such as a pushbutton (not shown), on a periodic basis, always, or upon some other event.

Although not shown, the strobe device 30 may also have an audible annunciator, such as a horn, bell or whistle, for audibly warning the public of a hazardous condition.

While the system has been particularly shown and described with references to particular embodiments, it will be understood by those of ordinary skill in the art that various changes in form and details may be made without departing from the scope of the invention. For example, the methods of the invention can be applied to various environments, and are not limited to the described environment.

What is claimed is:

1. The alarm system notification device comprising:

a strobe; and a communication port through which the alarm notification device receives a command from a control panel to select a strobe intensity from at least a first intensity and a second intensity, both the first intensity and the second intensity providing at least some intensity with the first intensity being different from the second intensity, the control panel being remote from the alarm notification device, the alarm notification device in response to said command configuring itself to strobe at the selected intensity where the device transmits through the communication port an indication of the selected strobe intensity.

2. The alarm system notification device of claim 1, further comprising:

a non-volatile memory for storing an indicator of the selected strobe intensity.

3. The alarm system notification device of claim 1, further comprising:

a volatile memory for storing an indicator of the selected strobe intensity.

4. The alarm system notification device of claim 1, further comprising:

an indicator that indicates to a person near the device the selected intensity.

5. The alarm system notification device of claim 4, the indicator being a visual indicator.

6. The alarm system notification device of claim 4, the indicator being a LED that flashes according to the selected intensity.

7. The alarm system notification device of claim 4, the indicator being a numeric display that indicates the selected intensity.

8. The alarm system notification device of claim 4, the indicator being an audible indicator.

9. The alarm system notification device of claim 1, further comprising:

a selector which allows manual selection of strobe intensity, the device transmitting through the communication port an indication of a selected strobe intensity.

10. The alarm system notification device of claim 1, where the communication port receives the command from the control panel after installation of the alarm notification device.

11. The alarm system notification device of claim 1, where the device transmits through the communication port to the control panel an indication of the strobe intensity for the device.

12. The alarm system notification device of claim 1, wherein the command comprises a configuration command.

13. An alarm system comprising:

plural addressable alarm system notification devices, at least one notification device having a strobe;

a control panel; and a communications channel through which the control panel commands a the at least one notification strobe device to select a strobe intensity from at least a first intensity and a second intensity, both the first intensity and the second intensity providing at least some intensity with the first intensity being different from the second intensity where the control panel receives, through the communication channel, an indication of the selected strobe intensity from the at least one notification device.

14. An alarm system control panel comprising:

a user interface which allows a user to configure a strobe intensity for at least one notification device having a strobe, the strobe being remote from the control panel, the strobe intensity being selected from at least a first intensity and a second intensity, both the first intensity and the second intensity providing at least some intensity with the first intensity being different from the second intensity; and a communications channel through which the control panel transmits a strobe intensity command to said notification device and through which the control panel receives an indication of the selected strobe intensity from said notification device.

15. A method for monitoring an alarm system notification strobe device, the method comprising, at the strobe device receiving a command from a control panel to select a strobe intensity, the control panel being remote from the alarm notification device, in response to said command to select a strobe intensity:

selecting one of a plurality of strobe intensities from at least a first intensity and a second intensity, both the first intensity and the second intensity providing at least some intensity with the first intensity being different from the second intensity; and transmitting, via a communication port, a message to the control panel, the message comprising an indication of a selected strobe intensity, and an identifier of the strobe device.

16. The method of claim 15, wherein the communication port utilizes a wired connection.

17. The method of claim 16, the wired connection comprising power lines, the strobe device transmitting the indication over the power lines.

18. The method of claim 15, further comprising:

storing, in a non-volatile memory, an indicator of the selected strobe intensity.

19. The method of claim 15, further comprising:

indicating to a person near the device the selected intensity.

20. The method of claim 19, the indicator being a visual indicator.

21. A method for controlling an alarm system notification strobe device, the method comprising, at the strobe device:

receiving, via a communication port, a command from a control panel to select an intensity from at least a first intensity and a second intensity, the control panel being remote from the alarm notification strobe device, both the first intensity and the second intensity providing at least some intensity with the first intensity being different from the second intensity;

responding to said command by configuring the strobe device to said intensity and transmitting a message via the communication port to the control panel, the message comprising an indication of a selected strobe intensity.

22. In an alarm system comprising plural addressable alarm notification devices, a control panel, and a communication channel, a method of controlling at least one of the addressable alarm notification devices comprising:

compiling a command comprising an identifier of at least one of the addressable alarm notification devices and an indication of a strobe intensity setting, the indication of the strobe intensity setting being selected from at least a first strobe intensity setting and a second strobe intensity setting, both the first intensity setting and the second intensity setting providing at least some intensity with the first intensity setting being different from the second intensity setting;

sending, via the communications channel, the command from the control panel to the at least one of the addressable alarm notification devices, the addressable alarm notification device configuring its strobe to the strobe intensity setting in the command and receiving, via the communication channel, a message from the addressable alarm notification device indicating a current strobe intensity setting.

23. The method of claim 22, where sending the command is performed after installation of the alarm notification device.

24. The method of claim 23, where sending the command is performed during operation of the alarm notification device.

25. The method of claim 24, where sending the command is performed during testing of the alarm notification device.

* * * * *